US008985336B1

(12) United States Patent
Yost et al.

(10) Patent No.: US 8,985,336 B1
(45) Date of Patent: Mar. 24, 2015

(54) DISPLAY CARTON AND METHOD OF ASSEMBLING

(71) Applicant: BISSELL Homecare, Inc., Grand Rapids, MI (US)

(72) Inventors: Lawrence Yost, Sparta, MI (US); Patrick William Laurie, III, Walker, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 14/163,012

(22) Filed: Jan. 24, 2014

Related U.S. Application Data

(60) Provisional application No. 61/758,458, filed on Jan. 30, 2013.

(51) Int. Cl.
*B65D 5/52* (2006.01)
*B65D 5/20* (2006.01)
*B31B 3/26* (2006.01)

(52) U.S. Cl.
CPC .... *B65D 5/20* (2013.01); *B31B 3/26* (2013.01)
USPC ..... 206/738; 229/122.34

(58) Field of Classification Search
USPC ..... 206/736, 738, 769, 775, 784; 229/122, 229/122.32, 122.34, 161, 162.1, 183, 103; 493/162, 163, 175
See application file for complete search history.

(56) References Cited

U.S. PATENT DOCUMENTS

| | | | | |
|---|---|---|---|---|
| 2,294,965 | A | 9/1942 | Davidson | |
| 5,595,304 | A | 1/1997 | Timmins | |
| 5,842,576 | A | 12/1998 | Snow | |
| 6,168,027 | B1 * | 1/2001 | Esser | 206/738 |
| 6,431,364 | B1 | 8/2002 | Saladyga | |
| 6,435,403 | B1 | 8/2002 | Giblin et al. | |
| 7,258,265 | B2 | 8/2007 | Loew | |
| 7,431,163 | B2 | 10/2008 | Andersen | |
| 7,472,819 | B1 | 1/2009 | Wachter | |
| 7,784,617 | B2 | 8/2010 | Urban | |
| 7,981,017 | B2 * | 7/2011 | Little et al. | 493/51 |
| 2006/0289334 | A1 * | 12/2006 | Lechelle et al. | 206/736 |
| 2012/0298550 | A1 * | 11/2012 | Martin et al. | 206/775 |
| 2013/0206828 | A1 * | 8/2013 | Schomisch | 229/122 |

FOREIGN PATENT DOCUMENTS

| | | | |
|---|---|---|---|
| GB | 2364995 | A | 2/2002 |

* cited by examiner

*Primary Examiner* — Jacob K Ackun
(74) *Attorney, Agent, or Firm* — McGarry Bair PC

(57) ABSTRACT

A display carton includes a bottom wall, a first side wall, a second side wall, a front wall with a rolled upper edge, and a rear wall, with the rear wall formed by overlapping, folded panels that are adhered together at the overlap. The display carton can be assembled from a blank, in part by folding panels together to partially overlap the panels, and adhering the panels together.

20 Claims, 5 Drawing Sheets

DISPLAY CARTON AND METHOD OF ASSEMBLING

CROSS-REFERENCE TO RELATED APPLICATION(S)

This application claims the benefit of U.S. Provisional Patent Application No. 61/758,458, filed Jan. 30, 2013, which is incorporated herein by reference in its entirety.

BACKGROUND

A display carton can be used for packaging multiple units of a product, such as consumable cleaning containers, together and for visually displaying the product, such as in a retail setting. Display cartons typically have an open top and at least one partially open side to allow for the product to be seen by consumers. Such cartons, while holding multiple units of product, are typically stacked on top of each other, and therefore need to be designed to withstand the weight of the product in the cartons. The carton also needs to be designed for providing information about the product in the carton to the customers. Display cartons are generally made of cardboard, such as corrugated cardboard material, and can be assembled by cutting and folding a blank, and gluing or otherwise adhering portions of the blank together to form the carton.

BRIEF SUMMARY

According to one embodiment of the invention, a display carton includes a bottom wall, a first side wall extending upwardly from the bottom wall, a second side wall extending upwardly from the bottom wall, a front wall extending upwardly from the bottom wall between the first and second side walls and formed by multiple panels defining a rolled upper edge, and a rear wall formed by a first folded portion of the first side wall and a second folded portion of the second side wall, wherein the first folded portion at least partially overlaps the second folded portion and the first and second folded portions are adhered together at the overlap.

According to another embodiment of the invention, a method for assembling a display carton having a bottom wall, a first side wall extending upwardly from the bottom wall, a second side wall extending upwardly from the bottom wall, and a rear wall extending between the first and second side walls is provided. The method includes folding a first panel to form a first rear panel section and a first side panel section, wherein the first side panel section defines the first side wall, folding a second panel to form a second rear panel section and a second side panel section, wherein the second side panel section defines the second side wall, adhering the first rear panel section to the second rear panel section to form the rear wall, and folding a third panel to form an inner panel section and an outer panel section which define a front wall with a rolled upper edge, wherein the front wall extends upwardly from the bottom wall between the first and second side walls.

DETAILED DESCRIPTION

Figure 1:
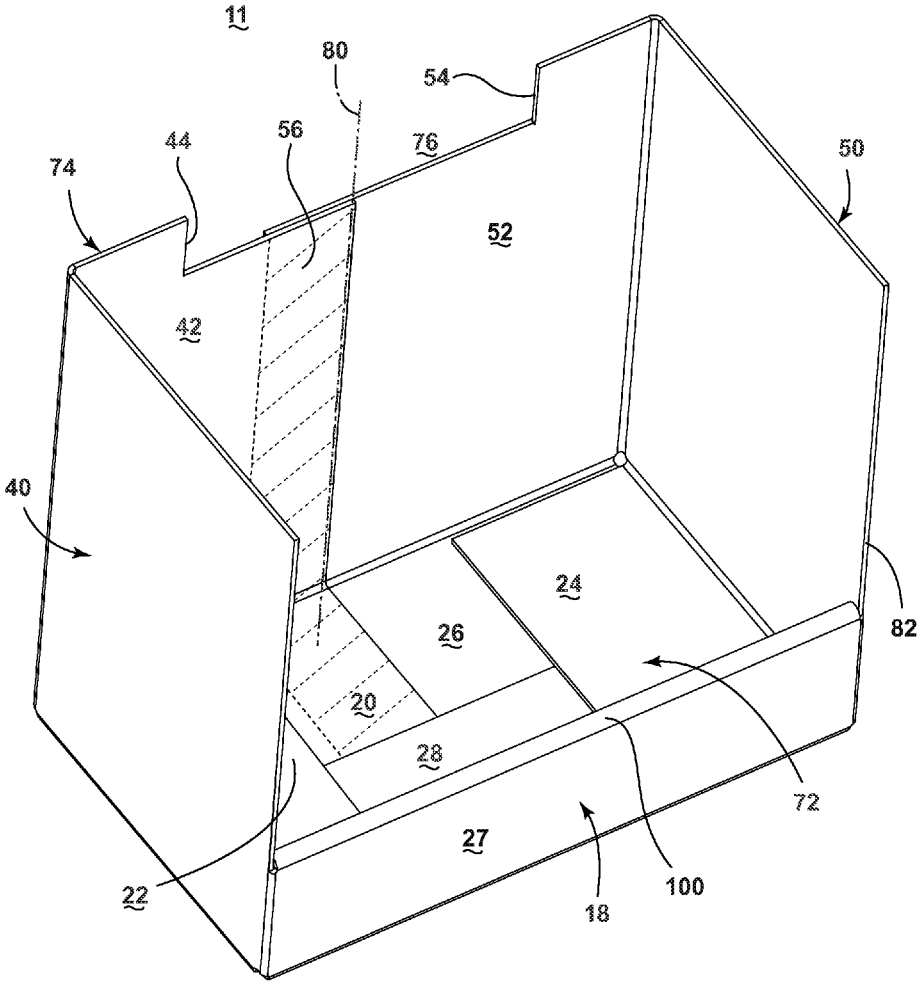
FIG. 1 is a front perspective view of a display carton according to one embodiment of the invention.

The invention generally relates to a display carton for packaging multiple units of a product, such as, but not limited to, consumable cleaning containers holding a cleaning chemistry. FIG. 1 is a front perspective view of an assembled display carton 11 according to one embodiment of the invention. The display carton 11 includes opposing first and second side walls 40, 50, a rear wall 74 extending between the side walls 40, 50, a front wall 18 opposing the rear wall 74 and extending between the side walls 40, 50, and a bottom wall 72 joining the side walls 40, 50, rear wall, and front wall 18.

The front wall 18 can extend upwardly from the bottom wall 72 between the first and second side walls 40, 50. The height of the front wall 18 can be less than the height of the side walls 40, 50 in order to provide a front opening 82 in the display carton 11 for sliding the product in and out of the display carton 11, and to provide information about the product in the display carton 11 to a user by allowing text and/or graphics on the product to be visible through the front opening 82. The front opening 82 spans the entire width of the front wall 18.

The rear wall 74 can be formed by first and second rear panel sections 42, 52, and further includes an upper edge which includes a medial portion having a cutout 76. The cutout 76 is formed by a first L-shaped edge 44 formed in the first rear panel section 42 and a second L-shaped edge 54 formed in the second rear panel section 52. The cutout 76 can form an opening to provide the information about the product in the display carton 11 to the user. For example, when the display carton 11 is vertically stacked with other cartons, the user can easily discern the carton contents and the number of products in the display carton 11 through the cutout 76. Multiple cutouts 76 can be provided in the upper edge of the rear wall 74. Alternatively, one or more cutouts 76 can be formed through the rear wall 74 for providing information to the user. Similar cutouts 76 can be provided in the upper edge of and/or through the first side wall 40 and/or the second side wall 50, in addition to or instead of the rear wall 74.

Figure 2:
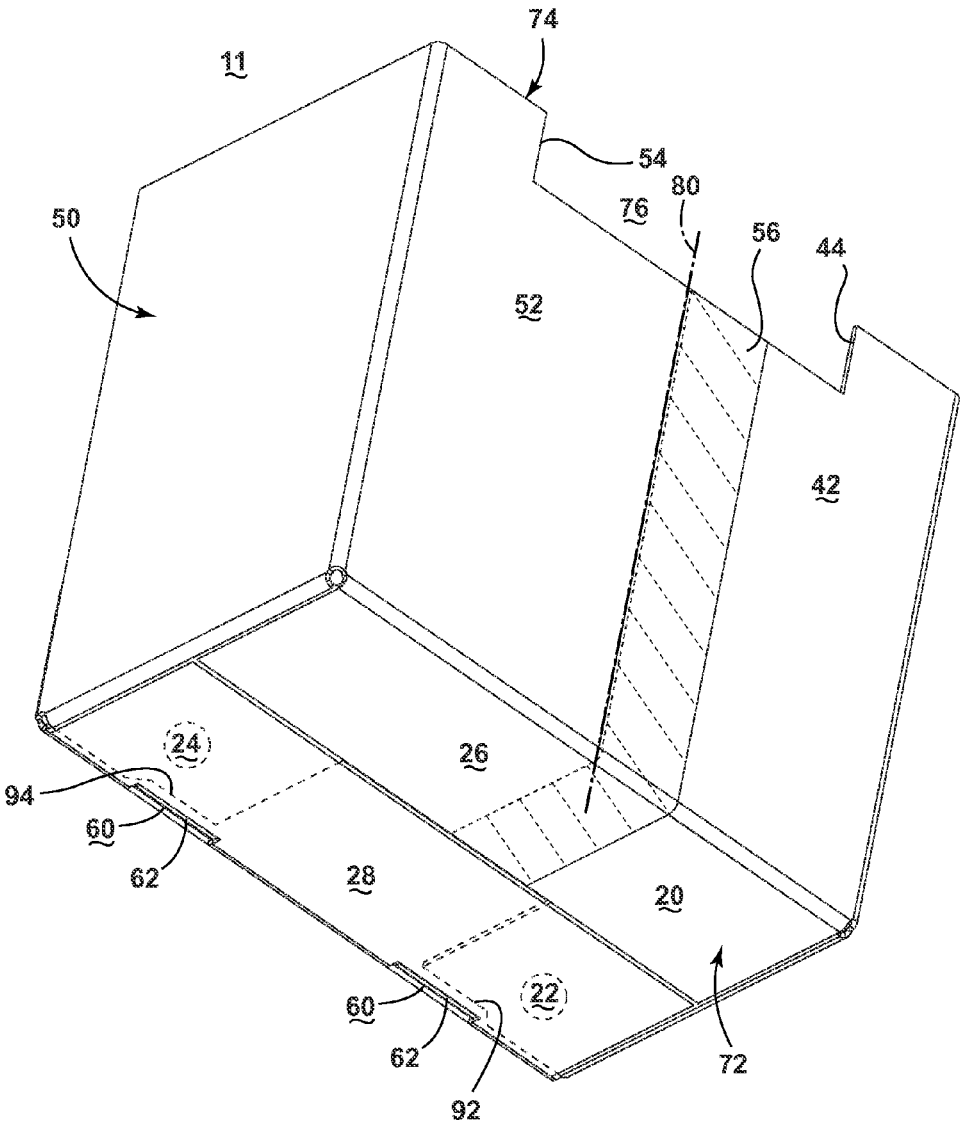
FIG. 2 is a rear bottom perspective view of the display carton from FIG. 1.

FIG. 2 is a rear bottom perspective view of the display carton 11 from FIG. 1. In the present embodiment, the bottom wall 72 is formed by multiple, stacked, partially overlapping flaps 20, 22, 24, 26, 28. The bottom wall 72 further includes one or more slots 60 which receive corresponding tabs 62 to assemble the front wall 18 (FIG. 1).

An overlap 56 is formed by overlapping portions of the rear panel sections 42, 52 and the flaps 20, 26. The overlap 56 extends downwardly along the rear wall 74, and at least partially along the bottom wall 72. The location of the overlap 56 can be configured to be offset from a center line 80 of the rear wall 74, and the position of overlap 56 can be biased toward either the first side wall 40, as illustrated in FIG. 1, or the second side wall 50 (not shown). In another embodiment, the overlap 56 can be centered along the center line 80 of the rear wall 74, without biasing to either side wall 40, 50.

Figure 3:
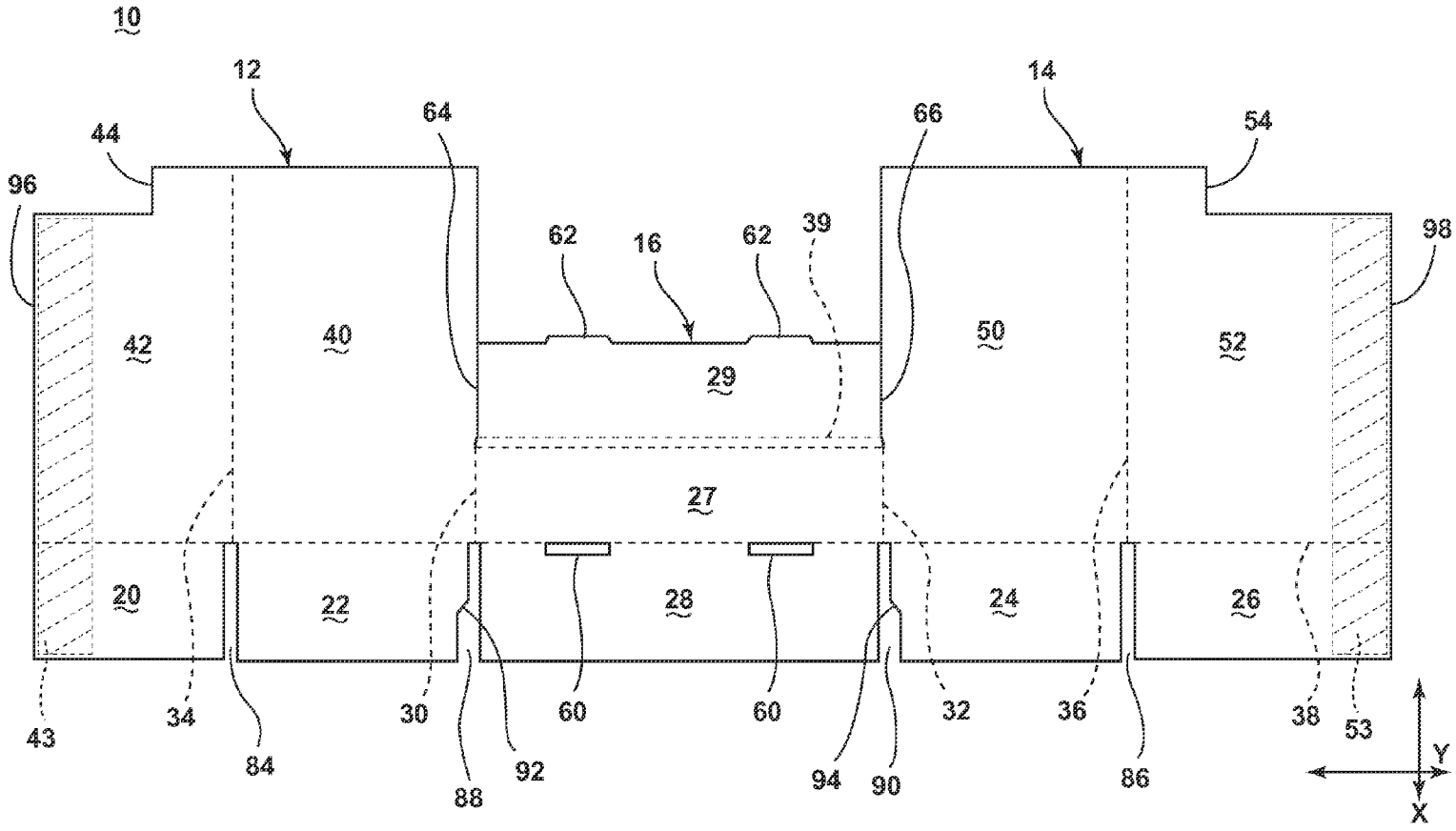
FIG. 3 is a top plan view of a carton blank which can be used to make the display carton of FIGS. 1-2.

FIG. 3 is a top plan view of one example of a carton blank 10 which can be used to make the display carton 11 of FIGS. 1-2. The carton blank 10 can be formed by die-cutting a sheet material and forming folding lines in predetermined locations and directions for easy folding of the panels of the carton blank 10 relative to one another. The folding lines can be "lines of weakness" in the blank 10, such as scored or crimped lines, formed in the blank 10. Other blank forming procedures can also be used to produce the blank 10, including, but not limited to hand-cutting and laser-cutting. The sheet material for the carton blank 10 can include corrugated cardboard, corrugated plastic or other materials with sufficient rigidity that can also be folded.

Conceptually, a Cartesian coordinate system can be applied to the blank 10, with an X-axis extending along the height of the blank 10, a Y-axis extending along the length of the blank 10, and a Z-axis (not shown) extending in a direction normal to the page. The X-axis and other axes parallel thereto define an "X-direction" of the blank 10, the Y-axis and other axes parallel thereto define a "Y-direction" of the blank 10.

The carton blank 10 includes a first end panel 12, a second end panel 14, and a third intermediate panel 16 between the first and second end panels 12, 14. The third intermediate panel 16 can be hinged to the first and second end panels 12, 14 at folding lines 30, 32, respectively. The folding lines 30, 32 run in the X-direction.

The first end panel 12 can be generally rectangular in shape, and can include the first side wall 40 and the first rear panel section 42. A folding line 34 running in the X-direction is formed in the first end panel 12 to define the first side wall 40 and first rear panel section 42, respectively. The height of the first panel 12 can be configured to be substantially same as the height of the units of product (not shown) that are to be received in the assembled display carton 11.

The second end panel 14 can be formed as a substantial mirror image of the first end panel 12, and can also be generally rectangular in shape, and can include the second side wall 50 and the second rear panel section 52. A folding line 36 running in the X-direction is formed in the second end panel 14 to define the second side wall 50 and second rear panel section 52, respectively. The height of the second end panel 14 can be configured to be substantially same as the height of the units of product (not shown) that are to be received in the assembled display carton 11.

The third or intermediate panel 16 includes the front wall 18, which can be of lesser height than the side walls 40, 50, and can include an outer front panel 27 hinged to an inner front panel 29 at a double folding line 39 running in the Y-direction. The outer front panel 27 forms the outer front surface of the wall 27 when the blank 10 is assembled, and is further connected to the first and second end panels 12, 14 by the X-direction folding lines 30, 32. The inner front panel 29 extends adjacent to the first and second side walls 40, 50, but is separated from the first and second side walls 40, 50 by slits 64, 66, respectively.

Multiple flaps extend from the lower sides of the panels 12, 14, 16, and are defined by a common folding line 38 running in the Y-direction, including a first end flap 20 which extends from the first rear panel section 42, a first intermediate flap 22 which extends from the first side wall 40, a second end flap 26 which extends from the second rear panel section 52, a second intermediate flap 24 which extends from the second side wall 50, and a central flap 28 which extends from the inner front panel 27.

The first flaps 20, 22 are separated from each other by a gap 84, and the X-direction folding line 34 of the first panel 12 can terminate at the gap 84 between the two adjacent first flaps 20, 22. The second flaps 24, 26 are likewise separated from each other by a similar gap 86, and the X-direction folding line 36 of the second panel 14 can terminate at the gap 86 between the two adjacent second flaps 24, 26. The central flap 28 is likewise separated from the intermediate flaps 22, 24 by gaps 88, 90, respectively.

The central flap 28 includes one or more slots 60 formed adjacent the folding line 38. The inner front panel 29 includes one or more corresponding tabs 62 on the free edge of the inner front panel 29, opposite the double folding line 39, which can be received in the slots 60. The intermediate flaps 22, 24 can include notched edges 92, 94 to accommodate the insertion of the tabs 62 into the slots 60, as described in more detail below.

The first rear panel section 42 and end flap 20 have a common first outer edge 96. Likewise, the second rear panel section 52 and end flap 26 have a common second outer edge 98. The L-shaped edges 44, 54 formed in the rear panel sections 42, 52, can be joined to the outer edges 96, 98, respectively.

The second rear panel section 52 and end flap 26 can be longer in the Y-direction than the first rear panel section 42 and end flap 20 to form an overlapping section 53 along the second outer edge 98 that is configured to extend over a corresponding overlapped section 43 along the first outer edge 96. The overlapped and overlapping sections 43, 53 form the overlap 56 shown in FIG. 2.

The shape of the outer perimeter of the blank 10 can be formed by die-cutting or another suitable blank forming procedure, including forming the L-shaped edges 44, 54 in the first and second end panels 12, 14, the tabs 62, the gaps 84, 86, 88, 90, and the notched edges 92, 94 in the intermediate flaps 22, 24. The slots 60 and slits 64, 66 can also be formed during the same blank forming procedure. The folding lines 30, 32, 34, 36, and 38 can be formed by scoring or crimping the blank 10.

The carton blank 10 in FIG. 3 can be assembled to form the display carton 11, as illustrated in FIGS. 1 and 2. One method of assembling the carton blank 10 is shown in FIGS. 3-7. The sequence of steps discussed is for illustrative purposes only and is not meant to limit the method in any way as it is understood that the steps may proceed in a different logical order, additional or intervening steps may be included, or described steps may be grouped and executed at different times or divided into multiple steps, without detracting from the invention.

Figure 4:
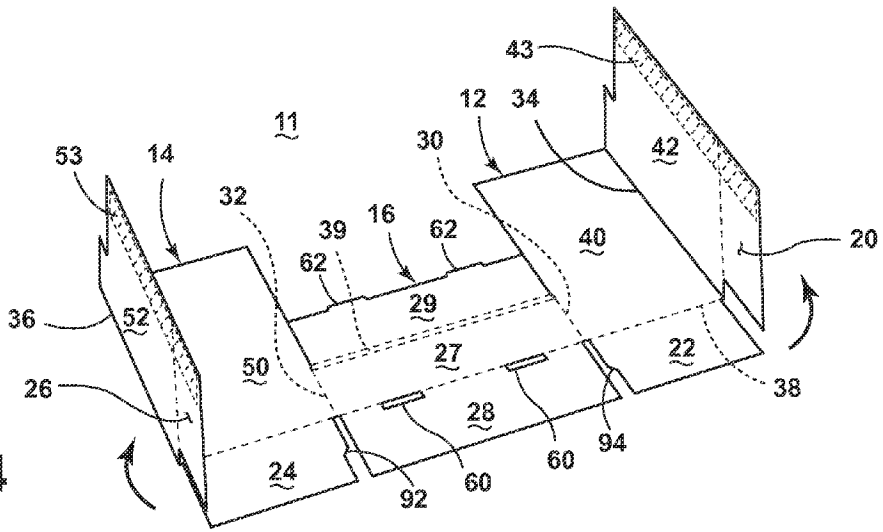
FIG. 4-7 show one method of assembling the carton blank of FIG. 3 into the display carton shown in FIG. 1-2.

As shown in FIG. 4, the rear panel sections 42, 52 are folded about the folding lines 34, 36, respectively, toward the intermediate panel 16. The side walls 40, 50 are also folded about the folding lines 30, 32, respectively, toward the intermediate panel 16 until the overlapping section 53 of the second rear panel section 52 overlaps the overlapped section 43 of the first rear panel section 42, as shown in FIG. 5.

Figure 5:
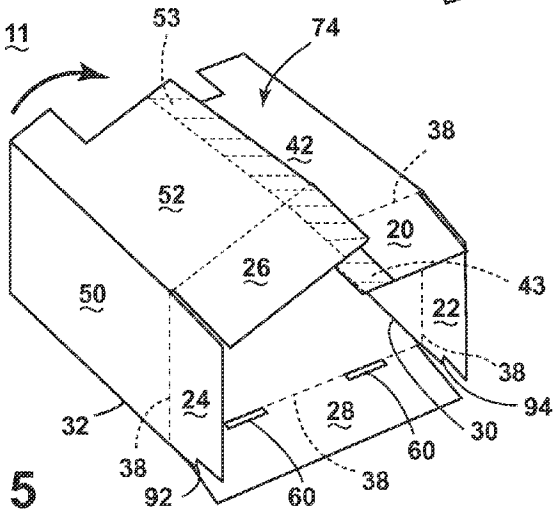

Referring to FIG. 5, during or after the folding step, an adhesive may be applied to at least one of the sections 43, 53 to adhere the sections 43, 53 together to form rear wall 74 with the overlap 56 shown in FIGS. 1-2. The adhesive can be glue or other another bonding material for chemically bonding the sections 43, 53. In addition to adhesion, a physical fastener, such as staples, can be applied to the sections 43, 53 to further secure the sections 43, 53 together.

Figure 6:
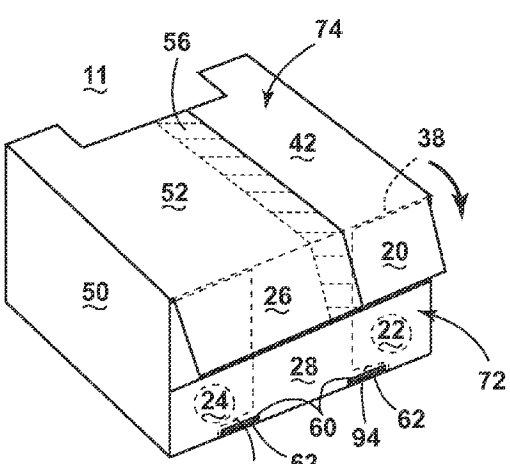

Referring to FIG. 6, the bottom flaps 20, 22, 24, 26, and 28 can be folded inwardly along the folding line 38, to form the bottom wall 72. The bottom flaps 20, 22, 24, 26, and 28 can be folded in many different orders and configurations to form the bottom wall 72. For example, as illustrated in FIG. 6, the intermediate flaps 22, 24 can be folded inwardly first, followed by folding central flap 28 over a portion of the underside of the intermediate flaps 22, 24. Then, the end flaps 20, 26, which are already adhered together to form the overlap 56, can be folded inwardly as one over a portion of the intermediate flaps 22, 24. In the illustrated embodiment, the central flap 28 and the end flaps 20, 26 meet at a common line when folded, and do not overlap each other, as shown in FIG. 2. During or after folding, an adhesive can be applied to at least a portion of the flaps 20, 22, 24, 26, and 28 such that all folded flaps 20, 22, 24, 26, and 28 are firmly adhered together form the bottom wall 72.

Figure 7:
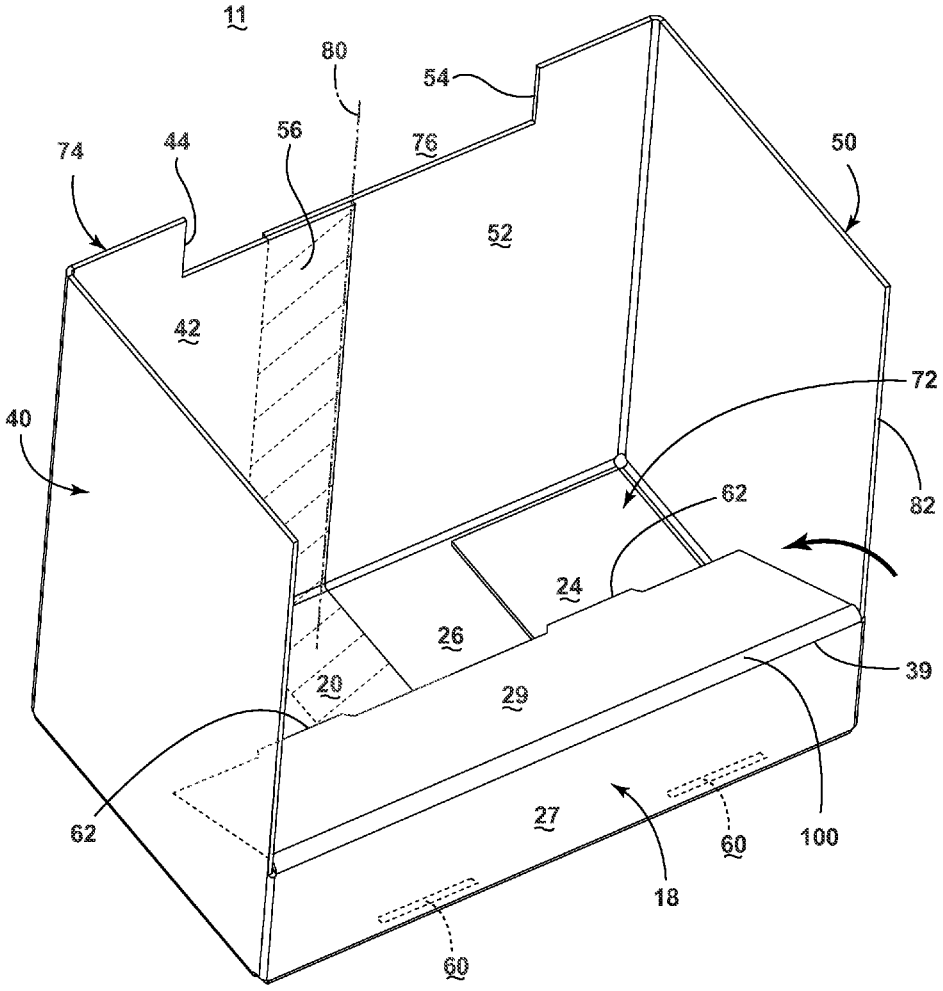

Referring to FIG. 7, the inner front panel 29 can be folded inwardly about the double folding line 39, toward the bottom wall 72, such that the inner front panel 29 lies against the outer front panel 27 to form the front wall 18. The tabs 62 on the inner front panel 29 are inserted into the slots 60 formed on the central flap 28 of the bottom wall 72 to secure the inner front panel 29 in place, as shown in FIGS. 1-2. The notched edges 92, 94 on intermediate flaps 24 and 26, respectively, provide adequate clearance around the slots 60 to accommodate insertion of the tabs 62 into the slots 60. When assembled as shown in FIGS. 1-2, the outer and inner front panels 27, 29 form the front wall 18 with a rolled upper edge 100 at the double folding line 39; thus, the display carton 11 can be referred to as a roll front carton. The rolled upper edge 100 provides a smooth surface and conceals the internal flutes of the corrugated material, unlike a standard cut edge which exposes the internal flutes.

During assembly, folding of the carton blank 10 about the folding lines 30, 32, 34, 36, and 38 can be performed by an automatic folding machine. Since the first set of folds about folding lines 30, 32, 34, 36 run in the same X-direction, all of the folds can easily be made by an automatic folding machine, eliminating the need for manual folding. Similarly, since the second set of folds about folding line 38 all run in the Y-direction, all of the folds can easily be made by an automatic folding machine. The only manual folding that may be required during the assembly of the carton blank 10 may be the folding of the front wall 18 about the double folding line 39.

While discussed separately herein, it is understood that the blank forming and carton assembling processes can happen sequentially in one facility, such as by using sequential machines for cutting, scoring, folding, and gluing to form the assembled display carton 11. A single machine can further perform more than one step. A step of printing, labeling or otherwise providing information on the carton 11, and/or coating the carton 11 with a water- or grease-resistant coating can also be part of the blank forming and carton assembling process.

The apparatus and methods disclosed herein provide an improved display carton 11. One advantage that may be realized in the practice of some embodiments of the described display carton 11 is that, during the assembly process, the display carton 11 requires only one manual folding step, and other folding steps can be done by an automatic folding machine, which can save assembly time. Another advantage that may be realized in the practice of some embodiments of the described display carton 11 is that the outer perimeter of the carton blank 10 is substantially rectangular, which maximizes the use of the blank material and can lower the materials cost. Yet another advantage is that the rolled upper edge 100 provides a smooth surface that conceals the internal flutes of the corrugated material and thus provides a more aesthetically pleasing appearance. The smooth rolled upper edge 100 also reduces the likelihood of consumers receiving paper cuts or scrapes while accessing product within the carton 11. Moreover, the front opening 82 extends across the entire front wall 18, which enhances visibility and eases removal of products contained therein compared to cartons having a less than full width front opening.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims. Hence, specific dimensions and other physical characteristics relating to the embodiments disclosed herein are not to be considered as limiting, unless the claims expressly state otherwise.

What is claimed is:

1. A display carton, comprising:

a bottom wall;

a first side wall extending upwardly from the bottom wall;

a second side wall extending upwardly from the bottom wall;

a front wall extending upwardly from the bottom wall between the first and second side walls and formed by multiple panels defining a rolled upper edge; and a rear wall formed by a first folded portion of the first side wall and a second folded portion of the second side wall, wherein the first folded portion at least partially overlaps the second folded portion and the first and second folded portions are adhered together at the overlap.

2. The display carton from claim 1, wherein the height of the rolled upper edge is less than the heights of the first and second side walls to define a front opening.

3. The display carton from claim 1, wherein the widths of both the first and second folded portions are less than the width of the rear wall.

4. The display carton from claim 1, wherein the overlap extends along the entire height of the rear wall.

5. The display carton from claim 1, wherein the overlap extends at least partially along the bottom wall.

6. The display carton from claim 5, wherein the overlap extends along the entire height of the rear wall.

7. The display carton from claim 1, wherein one of the multiple panels includes at least one tab and the bottom wall includes at least slot which receives the at least one tab.

8. The display carton from claim 1, wherein the rear wall further includes an upper edge having at least one cutout.

9. The display carton from claim 8, wherein the at least one cutout is formed by a first L-shaped edge formed in the first folded portion and a second L-shaped edge formed in the second folded portion.

10. The display carton from claim 1, wherein the bottom wall is formed by multiple, partially overlapped flaps.

11. A method for assembling a display carton having a bottom wall, a first side wall extending upwardly from the bottom wall, a second side wall extending upwardly from the bottom wall, and a rear wall extending between the first and second side walls, the method comprising:

folding a first panel to form a first rear panel section and a first side panel section, wherein the first side panel section defines the first side wall;

folding a second panel to form a second rear panel section and a second side panel section, wherein the second side panel section defines the second side wall;

adhering the first rear panel section to the second rear panel section to form the rear wall; and folding a third panel to form an inner panel section and an outer panel section which define a front wall with a rolled upper edge, wherein the front wall extends upwardly from the bottom wall between the first and second side walls.

12. The method from claim 11, wherein folding the first and second panels comprises automatically folding the first and second panels by an automatic folding machine.

13. The method from claim 12, wherein folding the third panel comprises manually folding the third panel by a person.

14. The method from claim 11, wherein folding the third panel comprises folding the inner panel section adjacent to the outer panel section.

15. The method of claim 14 and further comprising inserting a tab formed on the inner panel section into a slot provided on the bottom wall.

16. The method from claim 11, and further comprising folding multiple flaps to form the bottom wall.

17. The method from claim 16, wherein each of the multiple flaps are connected along a common folding line to one of the first, second, or third panels such that folding multiple flaps to form the bottom wall comprises folding each flap at the common folding line.

18. The method from claim 16, wherein folding the multiple flaps comprises automatically folding the multiple flaps by an automatic folding machine.

19. The method from claim 11, and further comprising:

folding the first side panel section about a first fold line connecting the first panel to the third panel; and folding the second side panel section about a second fold line connecting the second panel to the third panel.

20. The method from claim 19, wherein the first and second fold lines are parallel to fold lines between the first rear panel section and the first side panel and between the second rear panel section and the second side panel section.

* * * * *